US009487962B2

(12) United States Patent
Falk

(10) Patent No.: US 9,487,962 B2
(45) Date of Patent: Nov. 8, 2016

(54) APPARATUS AND METHOD FOR CLEANING FAçADES ON MULTI-STORY BUILDINGS

(75) Inventor: Jon Henrik Falk, Stockholm (SE)

(73) Assignee: Brunkeberg Systems AB, Höganäs (SE)

( * ) Notice: Subject to any disclaimer, the term of this patent is extended or adjusted under 35 U.S.C. 154(b) by 1035 days.

(21) Appl. No.: 13/636,512

(22) PCT Filed: Mar. 24, 2011

(86) PCT No.: PCT/EP2011/054539

§ 371 (c)(1),
(2), (4) Date: Nov. 13, 2012

(87) PCT Pub. No.: WO2011/117348

PCT Pub. Date: Sep. 29, 2011

(65) Prior Publication Data

US 2013/0081652 A1 Apr. 4, 2013

Related U.S. Application Data

(60) Provisional application No. 61/317,051, filed on Mar. 24, 2010.

(51) Int. Cl.
*E04G 23/00* (2006.01)
*A46B 11/00* (2006.01)
(Continued)

(52) U.S. Cl.
CPC ..... *E04G 23/004* (2013.01); *A46B 11/001* (2013.01); *A46B 13/001* (2013.01); *A47L 1/02* (2013.01); *A46B 2200/3073* (2013.01)

(58) Field of Classification Search
CPC ..... A46B 11/001; A46B 13/001; A46B 2200/3073; A47L 1/02; E04G 23/004
See application file for complete search history.

(56) References Cited

U.S. PATENT DOCUMENTS 1,561,801 A * 11/1925 Shipley ..... A47L 1/02 15/103
2,718,656 A 9/1955 Kirk
(Continued)

FOREIGN PATENT DOCUMENTS

CN 2423041 Y 3/2001
GB 172425 A 12/1921

*Primary Examiner* — Alexander Markoff
(74) *Attorney, Agent, or Firm* — Dilworth & Barrese LLP

(57) ABSTRACT

The present invention relates to an automatic cleaning apparatus (1) for cleaning facades on multi-story buildings. The apparatus comprises a rotating brush (11) arranged rotatable about its longitudinal axis, a drive mechanism (16) for rotating the brush, a container (18) for housing a cleaning fluid, and a fluid feeding device adapted to feed the rotating brush with cleaning fluid from the container by means of capillarity forces. The apparatus is designed to engage to steering guides (4) provided on the facade. The apparatus is designed so that a downward movement of the apparatus is solely powered by gravity forces acting on the apparatus. The drive mechanism for rotating the brush comprises at least one drive wheel (16) arranged to be in contact with the surface of the facade and to generate a friction powered torque during downward movement of the cleaning apparatus, and a transmission unit arranged to transfer the torque of the drive wheel to the rotating brush to make the brush rotate during the downward movement. The apparatus further comprises a wiper device (22) arranged above the rotating brush and adapted to be in contact with the facade during cleaning to wipe off used cleaning fluid from the facade, and a fluid collecting member arranged to collect the cleaning fluid wiped off by the wiper device, and to transport the collected cleaning fluid to the container for reuse.

19 Claims, 5 Drawing Sheets

(51) Int. Cl.
*A46B 13/00* (2006.01)
*A47L 1/02* (2006.01)

(56) References Cited

U.S. PATENT DOCUMENTS

| | | | | | |
|---|---|---|---|---|---|
| 3,080,592 | A | | 3/1963 | Hassage | |
| 3,298,052 | A | * | 1/1967 | Wolfe | A47L 1/02 15/103 |
| 3,775,804 | A | * | 12/1973 | Hoener, Jr. | A47L 1/02 15/302 |
| 3,895,406 | A | | 7/1975 | Fannon, Jr. | |
| 4,025,984 | A | * | 5/1977 | Hoener, Jr. | A47L 1/02 15/302 |
| 4,257,138 | A | * | 3/1981 | Clements | A47L 1/02 15/103 |
| 5,465,446 | A | * | 11/1995 | Chang | A47L 1/02 15/103 |
| 5,655,247 | A | * | 8/1997 | Allen | A47L 1/02 15/103 |
| RE36,649 | E | | 4/2000 | Jefferies et al. | |
| 6,170,109 | B1 | * | 1/2001 | Jesadanont | A47L 1/02 15/103 |
| 6,550,090 | B1 | * | 4/2003 | Jesadanont | A47L 1/02 15/103 |
| 6,986,186 | B1 | * | 1/2006 | Dube | A47L 1/02 15/250.01 |
| 7,231,683 | B1 | * | 6/2007 | Cruz | A47L 1/02 15/103 |
| 2003/0106176 | A1 | * | 6/2003 | Wang | E04G 23/002 15/50.3 |
| 2003/0140438 | A1 | * | 7/2003 | Thurnher | E04G 23/002 15/103 |
| 2006/0096050 | A1 | * | 5/2006 | Simonette | B08B 3/024 15/103 |
| 2008/0295265 | A1 | * | 12/2008 | Gorman | E04G 23/002 15/4 |
| 2009/0044833 | A1 | * | 2/2009 | Simonette | A47L 1/02 134/18 |
| 2009/0100618 | A1 | * | 4/2009 | Chen | E04G 23/002 15/103.5 |
| 2011/0180098 | A1 | * | 7/2011 | Lange | A47L 1/02 134/6 |

* cited by examiner

APPARATUS AND METHOD FOR CLEANING FAçADES ON MULTI-STORY BUILDINGS

CROSS-REFERENCE TO RELATED APPLICATION(S)

The present application is a national phase application of International Application No. PCT/EP2011/1054539 filed Mar. 24, 2011 and in turn claiming priority under 35 U.S.C. §119(e) to U.S. provisional appln. No. 61/317,051 filed Mar. 24, 2010.

FIELD OF THE INVENTION

The present invention relates to an automatic cleaning apparatus for cleaning multi-story façades on buildings. The invention also relates to a method for automatically cleaning façades on buildings. The cleaning apparatus according to the invention is particularly useful for cleaning windows. However, it can advantageously be used for cleaning façades of other material than glass, such as metal, concrete and wood.

BACKGROUND OF THE INVENTION

Manually cleaning of façades and windows of multi-story buildings is ineffective, dangerous and weather dependent. Different kinds of automatic cleaning equipment have been developed.

U.S. Pat. No. 3,895,406 discloses an automatic window washer having a washing module riding in vertical tracks on the face of a building and is controlled by a unit mounted on the roof of the building. The automatic washing operation of the components of the washing module is controlled by electric, fluidic and pneumatic systems.

CN2423041 discloses a high altitude cleaning machine including a machine body and a rubber wheel. A winding engine is used to hang the cleaning machine on the surface of a multi-story building and to vertically move the cleaning machine. The gravity force acting on the machine is converted into thrust force to thrust the machine towards the surface of the building. The rubber wheel is caused to rotate by the friction of the surface of the building through the action of gravity, and power is generated to drive the cleaning brush to rotate. The device includes a cleaning agent spray pipe for spraying the cleaning agent on the window.

U.S. Pat. No. 5,707,455 discloses an automatic cleaning apparatus of an exterior wall of a building. The apparatus includes a container for housing washing water, and a pump driven by a motor. The washing water is pumped through a water pipe and sprayed against the window. The used washing fluid is recovered.

U.S. Pat. No. 3,080,592 discloses an automatic window washer recovering used cleaning liquid, which also filters the recovered cleaning liquid. The window washer includes a drive motor driving a plurality of rotating sponges, a liquid storage reservoir, and a pump operated by the drive motor for delivering cleaning liquid from the reservoir to the sponges. The cleaning liquid is sprayed on the edges of the sponges when the sponges rotate. A squeegee wiper is arranged above the sponges for wiping off used cleaning liquid from the window.

U.S. Pat. No. 3,775,804 discloses a window wall washing device for multi-story buildings. The device includes an enclosed chamber for recovering cleaning fluid. From the enclosed chamber the cleaning liquid is recirculated for reuse through a liquid reservoir. An inclined interior wall cooperates with a vertical plate to form a trough in which recovered cleaning liquid is collected from drain tube, which communicates at its upper end with the trough and at its lower end with the reservoir. A liquid pump draws the cleaning liquid from the reservoir through an inlet hose and delivers the cleaning liquid under pressure to a plurality of nozzles, which spray the cleaning liquid on the window. One of the nozzles is arranged below the brush and one of the nozzles is arranged above the brush, so that the windows are wet before the brushing takes place. This improves the result of the cleaning, since the dirt on the window is dissolved or at least loosen by the cleaning liquid so that the brush can easily remove the dirt. However, the use of hoses to transport the cleaning liquid over several floors may cause problems, for example, by causing leakage because of friction or with tangling.

GB172,425 discloses a power driven window cleaning device. This cleaning device includes a cleaning module arranged on a handle adapted to be held by a human, and accordingly the device is not suitable for cleaning multi-story buildings. The device includes brush rotatably mounted in a casing, and a motor for rotating the brush. A front part of the brush is adapted to be in contact with the window during the cleaning. A tank for housing a cleaning liquid extends longitudinally of the casing and adjacent the brush. The tank is provided with an opening in its top wall, which opening is normally closed by a plug, so at to permit a washing solution to be poured into the tank. The tank is further provided with an opening through its front wall, which communicates with a wick tube, in which operates a wick. The wick is submerged in the solution in the tank and projecting so as to rest against the bristles of the brush and feed the cleaning liquid thereto be capillarity. The tank is located behind the brush and the wick feeds the cleaning liquid to a rear part of the brush. A disadvantage with this device is that due to the rotation of the brush, most of the cleaning liquid is removed from the brush before it reached the window to be cleaned. Further, this device does not provide a spraying of the cleaning liquid on the window, before the brushing takes place. This results in a poor cleaning of the windows.

The above mentioned cleaning apparatuses are complicated machines, and this is a disadvantage when it comes to operation, service and repair on a device in the environment normally exposed to heavy wind, water and pollution. Further, all of them rely on electricity to operate the washing apparatuses, for example, for driving a rotating brush or sponges, or for driving pumps for spraying the cleaning fluid on the windows. This is a particularly disadvantage if the cleaning machine is to be used for cleaning multi-story buildings due to difficulties to supply the power to the cleaning machine.

OBJECTS AND SUMMARY OF THE INVENTION

One object of the present invention is to provide a cleaning apparatus that provides an efficient cleaning of façades without the need of electricity to drive pumps to spray cleaning fluid on the façades and without the need of fluid hoses for supplying the brush with cleaning fluid during cleaning.

Another object of the present invention is to provide a cleaning apparatus without the need of hoses to supply the apparatus with cleaning fluid during cleaning.

A further object of the invention is to provide a cleaning apparatus without the need of electrical power and accordingly has no need of electrical cabling.

A further object of the invention is to provide a simple and light weight cleaning apparatus.

According to one aspect of the present invention, at least some of the above-mentioned objects of the invention are achieved by the cleaning apparatus as defined in claim 1.

Such an apparatus comprises a rotating brush arranged rotatable about its longitudinal axis, and arranged so that a front part of the brush is in contact with a surface of the façade during cleaning, a drive mechanism for rotating the brush, a container for housing a cleaning fluid, and a fluid feeding device adapted to feed the rotating brush with cleaning fluid from the container by means of capillarity forces. The invention is characterized in that the apparatus is designed to engage to steering guides provided on the façade for securing the cleaning apparatus to the façade and vertically guiding the cleaning apparatus, the apparatus is designed so that a downward movement of the apparatus is solely powered by gravity forces acting on the apparatus, the drive mechanism for rotating the brush comprises at least one drive wheel arranged to be in contact with the surface of the façade and to generate a friction powered torque during downward movement of the cleaning apparatus, and a transmission unit arranged to transfer the torque of the drive wheel to the rotating brush to make the brush rotate during the downward movement, a wiper device arranged above the rotating brush and adapted to be in contact with the façade during cleaning to wipe off used cleaning fluid from the façade, and a fluid collecting member arranged to collect the cleaning fluid wiped off by the wiper device, and to transport the collected cleaning fluid to the container for reuse.

This cleaning apparatus has no need of hoses to supply the apparatus with cleaning fluid and no need of electrical cabling, which facilitates the motion of the apparatus and reduces the complexity of the machine. The apparatus is simple and light weight since no electrical motors or electrical transmission is needed.

According to another aspect of the present invention, at least the some of the above-mentioned objects of the invention are achieved by the method as defined in claim 13.

The method comprises:

engaging the cleaning apparatus to steering guides provided on the façade of the building, moving the apparatus vertically in a downward movement guided by the steering guides while said front part of the rotating brush, said drive wheel, and said wiper device are in contact with the surface of the façade, transmission of the friction powered torque of the drive wheel to the rotating brush to make the brush rotate and to press the brush against the façade, feeding the rotating brush with cleaning fluid from said container by means of capillarity forces, collecting the cleaning fluid wiped off by said wiper device, and transporting the collected cleaning fluid to the container for reuse.

According to an embodiment of the invention, the method comprises during an upwards return movement:

disengaging said transmission of friction powered torque to the brush thereby causing the brush to reverse from the façade and stop rotating.

According to an embodiment of the invention, the method further comprises during said downward movement:

transmission of the friction powered torque of the drive wheel to the wiper device to press the wiper device against the façade, and the method further comprises during said upward movement:

disengaging said transmission of friction powered torque to the wiper device thereby causing the wiper device to reverse from the façade.

According to another aspect of the invention at least the first of the above-mentioned objects is achieved by the cleaning apparatus as defined in claim 16.

Such an apparatus comprises a housing provided with an opening, and a rotating brush (11) arranged so that a front part of the brush is facing the opening of the housing, and the feeding device is arranged below the rotating brush and so that the bristle of the rotating brush and/or the upper end of the feeding device is bent during contact between them, and the drive mechanism is arranged to rotate the rotating brush in a direction relative the feeding device so that cleaning fluid is splashed towards the opening of the housing when the contact between bristle the feeding device is released. The feeding device is arranged so that the upper end of the feeding device is in contact with the bristle of the rotating brush at a position close to the front part of the rotating brush. Which one of the bristle and the feeding device is bent depends on the flexibility of the bristle and the feeding device. If the bristle is more resilient than the feeding device, the bristle of the rotating brush is bent away from the façade by the contact with the feeding device and accordingly biased, thereby causing the cleaning fluid on the bristle to be splashed towards the façade when the contact with the feeding device is released. if the feeding device is more resilient than the bristle, the feeding device is bent, and accordingly biased, by the contact with the bristle during rotation of the brush, thereby causing the cleaning fluid on the end of the feeding device to be splashed towards the façade when the contact with the bristle is released. If the bristle and the feeding device has about the same flexibility, both will be bent.

Due to the positioning of the feeding device with respect to the rotating brush, the feeding device causes the cleaning fluid on the brush to be splashed on the surface of the façade so that the surface becomes wet a moment before the brushing takes place. This improves the result of the cleaning, since the dirt on the window is dissolved or at least loosen by the cleaning liquid so that the brush can easily remove the dirt. Further, the invention ensures that most of the liquid fed to the brush is transferred to the façade. Further, no electrical power is needed to the machine to drive pumps to spray cleaning fluid on the façade and no fluid supply hoses are needed to transport the cleaning fluid from the container to the brush.

According to an embodiment of the invention, the fluid feeding device is arranged inclined relative the bristle of the rotating brush in the rotational direction of the rotating brush. This embodiment reduces the friction between the linear and the rotating brush, and increases the contact surface between the brushes. The result is a better "splash" effect and accordingly in a more efficient cleaning.

According to an embodiment of the invention, the fluid feeding device includes a large number of elongated elements extending in the longitudinal direction of the device and ending at the upper end of the device, the elongated elements being arranged essentially in parallel and so close to each other that the cleaning fluid is transported between the elongated elements by means of capillarity forces. The elongated elements transport the cleaning fluid by means of capillarity forces to the bristle of the brush. The elongated elements can be resilient, for example, straws of a liner brush. Suitably, the fluid feeding device extends in the longitudinal d direction of the rotating brush so that the cleaning fluid is feed to the brush along its whole length. This embodiment makes it possible to evenly supply the cleaning fluid over the whole length of the rotating brush.

According to an embodiment of the invention, the fluid feeding device comprises a linear brush including a bristle arranged with its upper end in contact with the bristle of the rotating brush. In this embodiment, the elongated elements form the bristle of a linear brush. Suitably, the linear brush extends along the entire length of the rotating brush. By providing the bristles in contact with each other, the wear is reduced and the removal of the fluid on the linear brush is improved.

According to an embodiment of the invention, the container is positioned below the rotating brush. The positioning of the container below the rotating brush makes it possible to arrange the upper end of the feeding device in contact with the rotating brush at a position close to the front part of the rotating brush, and accordingly makes it possible to feed the cleaning fluid to the brush at a position close to the façade to be cleaned.

According to an embodiment of the invention, the apparatus comprises a self-leveling mechanism for automatically keeping the fluid in the container at an essentially constant level. Preferably, the self-leveling mechanism is arranged to keep the fluid in the container at a level in the range of about 0.5-4 cm below the rotating brush. There is a maximum possible distance for a fluid to be vertically transported by means of capillarity forces. Further, to achieve the splash effect, the brush is not allowed to be in contact with the fluid in the container. This embodiment ensures that the fluid level in the container is kept at an optimal level to achieve a satisfactory supply of fluid to the brush.

According to an embodiment of the invention, said self-leveling mechanism comprises: a tank for housing cleaning fluid, the tank being arranged above and in fluid communication with the container, and a pipe having an inlet arranged in the bottom of the tank and an outlet arranged inside the container and just below the fluid level of the container. If the fluid level descends below the outlet of the pipe, air will leak to the tank and fluid will fill up until the level is above the outlet of the pipe. This embodiment provides a simple and reliable self-leveling mechanism.

According to an embodiment of the invention, the apparatus comprises a squeegee arranged above the rotating brush and adapted to be in contact with the window during cleaning to wipe off the used fluid, and a fluid collecting member arranged below the squeegee to collect the cleaning fluid wiped of by the squeegee, and to transport the collected cleaning fluid to the container for reuse. Further, the apparatus comprises a filter and the fluid collecting member is arranged to transport the collected cleaning fluid to the container via said filter. As the used fluid is filtered and recycled, there is no need of cleaning fluid supply during operation of the apparatus, and accordingly no hoses for fluid supply to the apparatus is needed.

According to an embodiment of the invention, the fluid collecting member comprises a linear brush arranged below the squeegee and adapted to be in contact with the window to collect the cleaning fluid wiped off by the squeegee, and an inclining sheet having one end arranged below the linear brush to transport the collected cleaning fluid to the container for reuse. The linear brush arranged below the squeegee ensures that most of the cleaning fluid on the façade is collected and recycled. An efficient collection and reuse of the used cleaning fluid is important to avoid the need of refilling the tank with cleaning liquid during cleaning of a building, in particular if the building is a multi-story building. Further, an efficient collection and reuse of the used cleaning fluid makes it possible to reduce the size of the tank, and by that reduce the size and weight of the cleaning apparatus.

According to an embodiment of the invention, the wiper device and the fluid-collecting brush are arranged so that an upper end of the linear brush is in contact with the wiper device during an upward travel of the apparatus to wipe off dirt from the squeegee, and the apparatus is arranged to disengage the rotation of the brush during an upward travel of the apparatus, and the apparatus is arranged so that the wiper device and the fluid collecting member are move away from the façade when the movement is revered thereby casing the wiper device to be moved in contact with the fluid collecting brush.

This embodiment achieves an automatic cleaning of the squeegee during upward travel of the apparatus. This is important as dirt on the squeegee does not only reduce the wiping capacity of the squeegee, but also may cause scratches on windows of the façade.

According to an embodiment of the invention, the apparatus is designed to engage to steering guides formed on vertical profiles mounted on the façade for securing the cleaning apparatus to the façade and vertically guiding the cleaning apparatus, and the apparatus is designed so that down movement of the apparatus is powered by gravity forces acting on the apparatus. The up and down movement of the apparatus is, for example, controlled by a crane on the roof of the building, for example, connected to the apparatus by a wire. This means that the apparatus has no need of electrical power to move the apparatus up and down along the façade, and accordingly no electrical cables are needed.

According to an embodiment of the invention, the drive mechanism for rotating the brush comprises at least one drive wheel arranged to be in contact with the surface of the façade and to generate a friction powered torque during down movement of the cleaning apparatus, and a transmission unit arranged to transfer the torque of the drive wheel to the rotating brush to make the brush rotate during the down movement. This means that the apparatus has no need of electrical power to rotate the brush, and accordingly no electrical cables or a battery are needed.

According to another aspect of the invention, at least some of the above mentioned objects are achieved by the method according to claim 30. The method comprises:

- moving the apparatus vertically in a downward movement while said front part of the rotating brush is in contact with the surface of the façade, and
- feeding the rotating brush with cleaning fluid from said container by means of capillarity forces, and
- rotating the brush relative the feeding device so that the bristle of the rotating brush or the feeding device is bent during the contact between them, thereby causing cleaning fluid to be splashed towards the surface of the façade when the contact with the feeding device is released.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

Figure 1:
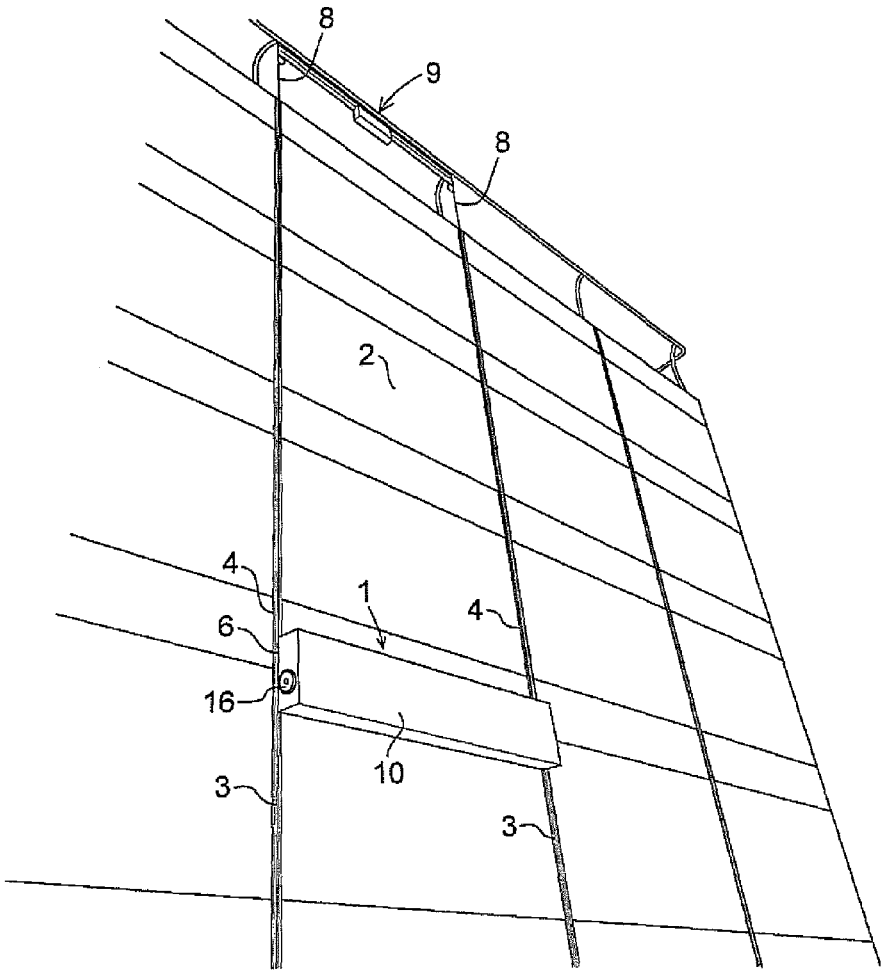
FIG. 1 shows a perspective view of a cleaning apparatus according to an embodiment of the invention cleaning a façade of a multi-story building.
Figure 2:
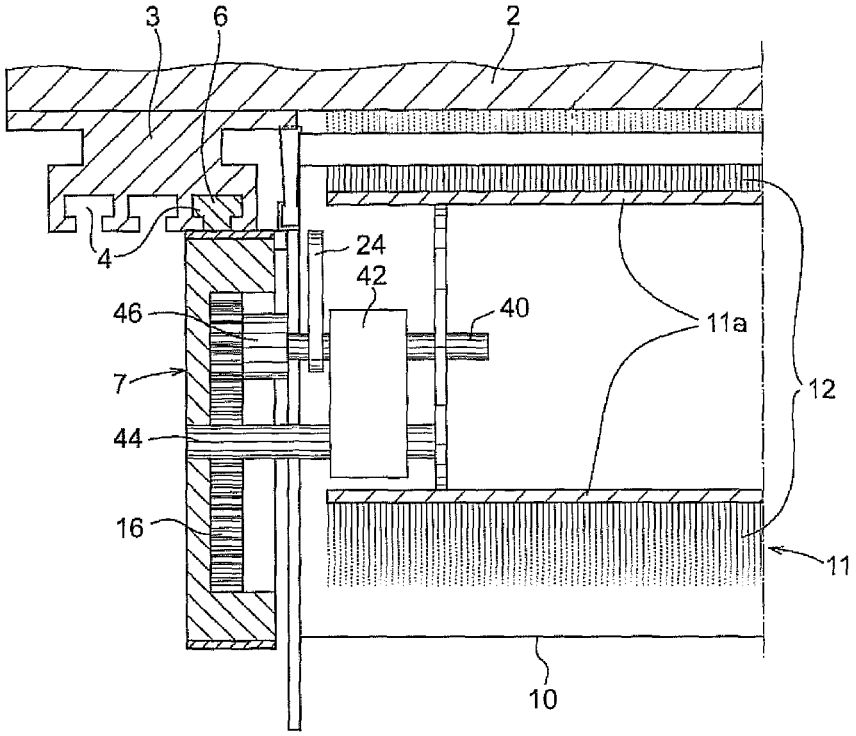
FIG. 2 shows a cross sectional view of a part of the cleaning apparatus seen from above.

FIG. 1 shows an example of a cleaning apparatus 1 according to the invention arranged for cleaning a façade of a multi-story building. FIG. 2 shows a cross sectional view of a part of the cleaning apparatus 1 seen from above. In this example, the façade to be cleaned includes façade panels 2 assembled between vertical parallel wind posts 3. The wind posts 3 are provided with steering guides for securing the cleaning apparatus to the façade and vertically guiding the cleaning apparatus. In this example, the steering guides are formed by vertical slots 4 on the outside face of the wind posts. In other embodiments of the invention, the steering guides may have other designs, such as bars or rails. The cleaning apparatus 1 covers the width of one façade panel 2 between two wind posts 3. Each side of the cleaning apparatus is provided with sliding elements 6 designed to engage to the slots 4, as shown in FIG. 2. The sliding elements 6 have some flexibility to compensate for differences in distance between the slots 4.

The cleaning apparatus hangs in one or two wires, or ropes 8 from a crane or a lift 9 on the roof of the building. During cleaning the cleaning apparatus is hanging in the wires 8 from the lift and is moved up and down, and between the façade sections around the building. This is, for example, done by a roof crane on rails on the roof. An alternative solution is to use a façade rail system mounted on top of the wind posts above and outside of the façade. The lift 9 is hanging on the rail and can be moved along the building perimeter to move the apparatus 1 between vertical sections of the façade during cleaning. When the cleaning apparatus is moved between façade sections it is lifted up above the wind posts sliding out of the slots in the wind post. Then the lift 9 with the cleaning apparatus 1 hanging in wires 8 is pushed to the next section and lowered to enter the wind post slots 4. To make it easier to enter the sliding elements 6 into the slots 4, there can be a guide jig attached to the top of the wind posts 3.

The cleaning process is done as the apparatus 1 slide downwards from the top of the building. The downward movement of the cleaning apparatus is solely powered by gravity forces acting on the apparatus. The upward movement of the apparatus is powered by the crane or lift 9. After the cleaning process, the apparatus is hoisted back up to the roof level, and the lift 9 can be moved along the façade perimeter to put the apparatus down into a garage/parking space on the roof.

Figure 3:
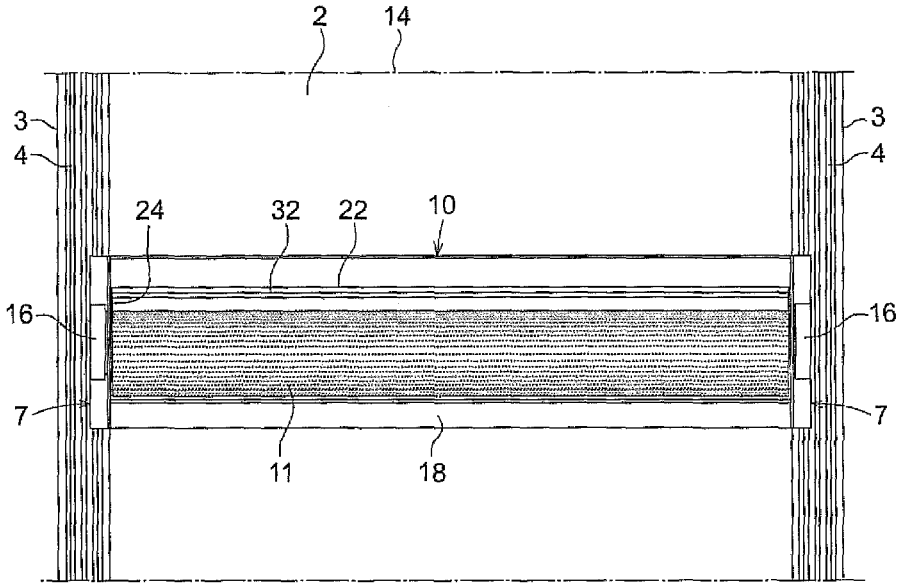
FIG. 3 shows a cross sectional view taken along the longitudinal axis of the cleaning apparatus and seen from the rear of the cleaning apparatus.
Figure 4B:
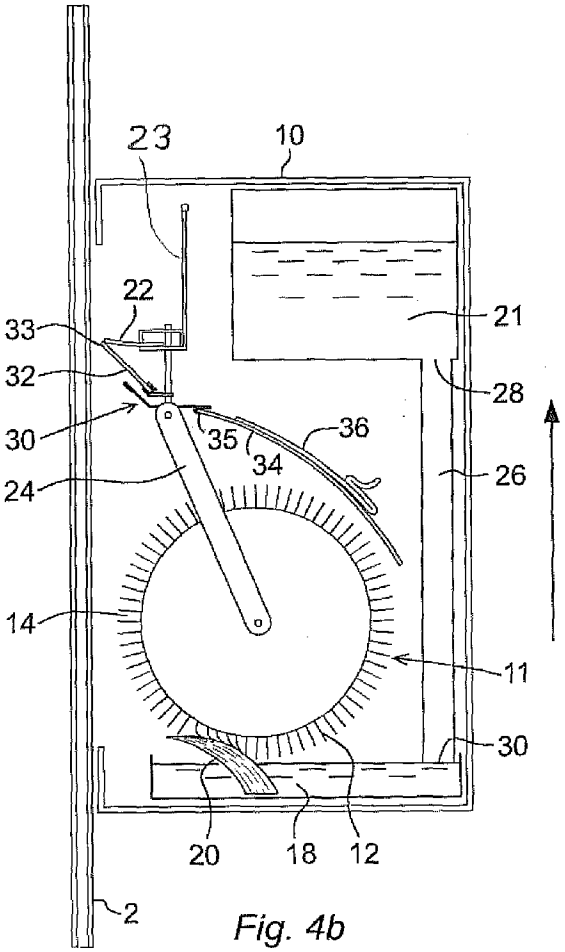
FIG. 4*b* shows a cross sectional view of the cleaning apparatus seen from the side during upward movement of the apparatus.
Figure 4A:
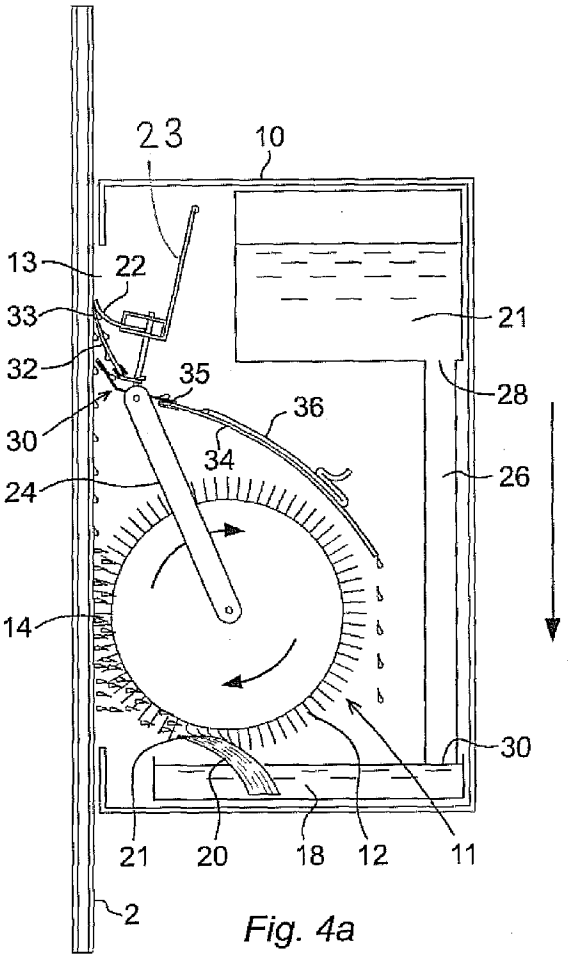
FIG. 4*a* shows a cross sectional view of the cleaning apparatus seen from the side during downward movement of the apparatus.

FIG. 3 shows a cross sectional view of the cleaning apparatus 1 seen from the rear and taken along the longitudinal axis of the cleaning apparatus. FIGS. 4*a-b* show cross sectional views of the cleaning apparatus 1 seen from the side and taken across the longitudinal axis of the cleaning apparatus. FIG. 4*a* shows the cleaning apparatus during downward movement of the apparatus and FIG. 4*b* shows the cleaning apparatus during upward movement of the apparatus. The apparatus 1 comprises a housing 10 and a cylindrical brush 11 rotatably mounted in the housing and arranged rotatable about its longitudinal axis. The brush 11 is cylindrical and includes a framework 11*a* and a bristle 12 including a large number of straws covering the envelope surface of the framework. During cleaning the brush is horizontally arranged and is rotated in an upward direction relative to the façade panels 2 of the façade. The housing 10 includes the sliding elements 6 and attachments for the lifting wires 8. The housing 10 is provided with an opening 13, and the brush 11 is arranged so that a front part 14 of the brush is in contact with the surface of the façade panel 2 of the façade during cleaning through the opening 13 in the housing 10.

The apparatus further comprises a drive mechanism for rotating the brush including a drive wheel 16 arranged on each side of the apparatus 1. The drive wheels 16 are adapted to be in contact with the surface of façade, or more particularly to rotate against the wind posts 3. The contact force between the drive wheels 16 and the wind posts 3 is outbalanced by the sliding elements 6 sliding in the slots 4 of the wind posts. The contact force on the drive wheels 16 generates a friction powered torque during upward and downward movements. During downward movement of the apparatus the friction torque of the drive wheels 16 is used to rotate the cylindrical brush 11. The drive mechanism further includes a transmission unit arranged to transfer torque of the drive wheel 16 to the rotating brush 11 to make the brush rotate during the downward movement and to press the brush against the façade panel during the downward movement. The transmission between the drive wheels 16 and the brush 11 is arranged to make the brush 11 rotate in the same direction as the drive wheels 16 and geared up to give the brush a necessary relative motion to the façade during down movement. The transmission between the brush 11 and the drive wheels 16 can be of several different types such as cog, a tooth belt or a chain.

The housing 10 includes two side plates 7 arranged on each side of the apparatus and a sheet metal casing that forms the outside of the apparatus between the side plates. The side plates 7 with the transmissions on the left and right side are made from laterally reversed parts. The side plates 7 connect to the wind post slots 4 via the sliding elements 6 and carry the driving mechanism. The slots 4 can have T-formed shapes, or any other shape that together with the sliding elements 6 on the right and left side keep the apparatus 1 in a horizontal position and the side of the apparatus facing the façade in parallel to the façade surface. The side plates 7 are connected by a bar on top connecting to the lifting wires 8.

The apparatus further comprises a container 18 for housing a cleaning fluid, a fluid feeding device 20 having a lower end submerged in the cleaning fluid of the container 18 and an upper end 21 in contact with the bristle 12 of the rotating brush 11. The container 18 is positioned below the rotating brush 11 and extends along the length of the brush 11. The top of the container 18 is provided with an opening to receive the lower end of the fluid feeding device 20. In this embodiment, the container 18 consists of a basin or a fluid tray arranged along the length of the apparatus, as shown in FIG. 3. The fluid feeding device 20 is adapted to feed the rotating brush 11 with cleaning fluid from the container 18 by means of capillarity forces.

The feeding device 20 is arranged below the rotating brush 11 so that the upper end 21 of the feeding device is in contact with bristle 12 of the rotating brush 11 at a position close to the front part 14 of the rotating brush. Cleaning fluid from the container 18 is transported to the bristle 12 of the rotating brush via the feeding device by means of capillarity forces. The drive mechanism is arranged to rotate the rotating brush 11 in a direction relative the feeding device 20 so that the bristle 12 of the rotating brush 11, which is in contact with the upper end 21 of the feeding device is bent and thereby causing the cleaning fluid on the bristle 12 to be splashed towards the surface of the façade when the contact between the bristle and the feeding device is released, as shown in FIG. 4*a*. The fluid feeding device 20 is arranged inclined relative the bristle 12 of the rotating brush in the rotational direction of the rotating brush, i.e. in the direction of the façade to be cleaned.

The fluid feed device transports cleaning fluid from the container 18 up to the rotating brush 11. The fluid feeding device 20 includes a large number of elongated elements, for example in straws, extending in the longitudinal direction of the device and ending at the upper end of the device. The elongated elements are arranged essentially in parallel so that the cleaning fluid is transported between the elongated elements by means of capillarity forces. In this embodiment of the invention, the fluid feeding device comprises a linear brush including a bristle arranged with its upper end in contact with the bristle of the rotating brush. However, the fluid feeding device 20 can be made in different ways. One solution is to transport fluid via a wick to the linear brush 20. The linear brush has contact with the bristle 12 of the rotating brush thereby transporting fluid to the brush 11. The linear brush 20 is spring loaded against the bristle 12 of rotating brush to maintain contact when it shifts between a 'home' position and a working position. Another possible solution is to have a soft roller in contact with the fluid surface of the container 18 and the bristle 12 of brush. During rotation of the brush lithe soft roller starts rotating in contact with the brush 11 thereby transporting fluid from the container 18 to the brush 11. This fluid feed mechanism is not limited to the above described methods.

The apparatus comprises a self-leveling mechanism for automatically keeping the fluid in the container 18 at an essentially constant level. The self-leveling mechanism is arranged to keep the fluid in the container at a level in the range of about 0.5-4 cm below the cylindrical brush 11. The self-leveling mechanism includes a fluid tank 21 for housing cleaning fluid. The tank is provided with an opening in its top wall, which opening is normally closed, for example by a plug, to permit a cleaning fluid to be poured into the tank. The tank 21 is arranged above the container 18 and the rotating brush 11. The container 18 is placed below the brush 11 in the bottom of the housing 10, and the fluid tank 21 is placed above the brush in the top of the housing. The tank 21 is arranged in fluid communication with the container 18. The self-leveling mechanism further includes a pipe, for example a hose 26, having an inlet 28 arranged in the bottom of the tank 21 and an outlet 30 arranged inside the container 18 and slightly below the fluid level of the container. The cleaning fluid in the container 18 is regulated to a constant level from the tank 21. The fluid tank 21 is closed and connected by the hose 26 to the container 18 under the fluid level of the container. If the fluid level in the container descends below the outlet 30 of the hose, air will leak to the tank 21 and fluid will fill up until the level is above the outlet 30 of the hose. When opening the tank to top up the cleaning fluid, a stop valve prevents the fluid to leak down to the container.

The apparatus also comprises a wiper device in the form of a squeegee 22 arranged above the rotating brush 11 and adapted to be in contact with the surface of the façade panel 2 during cleaning to wipe off used cleaning fluid from the façade. The ccontainer 18, the feeding device 20, and the squeegee 22 are arranged extending in the longitudinal direction of the rotating brush 11 and with the same length as the brush 11. The squeegee includes a blade made of rubber or other material, attached to a metal profile and set at an adjustable distance to the façade.

The squeegee 22 is at its ends connected to a pivoting arm 23. The pivoting arm 23 is connected to the axle ends of the rotating brush 11 via one or more link arms 24. When the rotating brush 11 shifts up against the façade during downward movement, the link arm 24 raises the pivoting arm 23 with squeegee 22 and pushes up the squeegee against the façade, as shown in FIG. 4*a*. During down movement, the brush 11 and the squeegee 22 are in contact with the façade panel. The brush and squeegee pressure against the façade panel is generated by the torque from the drive wheels 16. The position of the brush 11 and squeegee 22 in working position can be adjusted to different pressure against the façade surface. The rear end of the pivoting arm 23 is connected to the side plate 7 via a spring.

Figure 5B:
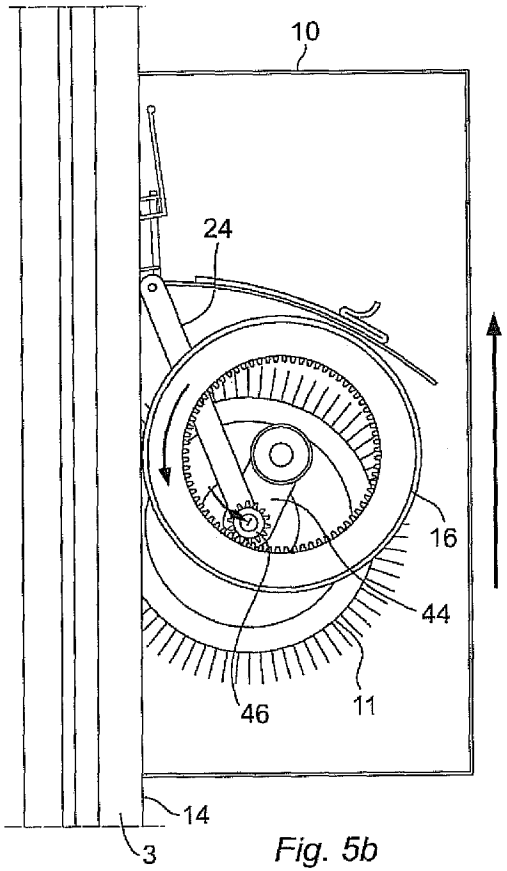
FIGS. 5*a-b* illustrates an example of a drive mechanism for rotating the brush during cleaning.
Figure 5A:
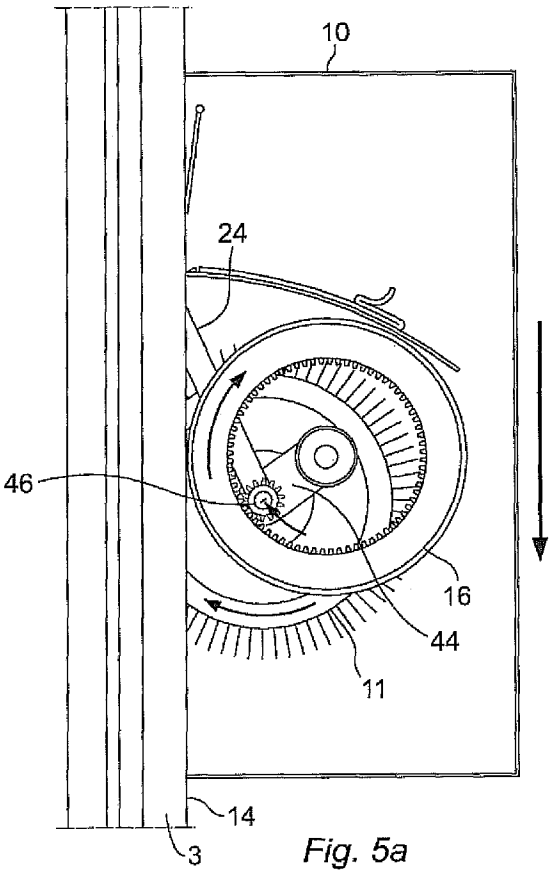

The drive wheel 16 rotates in a first direction, as shown in FIG. 5*a*, during a downward travel and in a second direction, as shown in FIG. 5*b*, during an upward travel. During return travel upwards the rotation of the brush 11 is disengaged and the brush 11 and squeegee are reversed from the façade, as shown in FIG. 4*a*. The brush, the squeegee, and the fluid collecting arrangement 30 are mechanically connected to the pivoting arm 23. When the movement of the apparatus is stopped, the pivoting arm 23 swings back to a vertical home position, as shown in FIG. 4*b*, thereby casing the brush, the squeegee, and the fluid collecting arrangement to be move away from the façade.

The disengagement of the brush 11 and the movement of the brush and squeegee are effectuated by the change of direction of the drive wheels 16. When the rotating brush 11 and squeegee 22 are in 'home' position the spring force almost balances the weight of the brush 11 and the squeegee 22. The spring force thereby reduces the need of friction force to raise the brush 11 and squeegee 22 to its working position. An alternative to a single Wiper blade lip is a rotating profile with radially mounted multiple wiper blades. The blades can be changed if they become ineffective due to wear or dirt deposits. One alternative could be to change wiper blades each time in parking position, another alternative is to make the rotating profile rotate one position when passing any horizontal ledge or joint between two façade panels. A further alternative could be a special type of wiper blade, for example, a T-shaped blade.

The apparatus further comprises and a fluid collecting arrangement 30 arranged to collect the cleaning fluid wiped off by the wiper device 22, and to transport the collected cleaning fluid to the container 18 for reuse. The fluid collecting arrangement 30 includes a fluid-collecting brush 32 arranged below the squeegee 22 so that an upper end 33 of the fluid-collecting brush is in contact with the façade panel 2 during downward travel of the apparatus to collect cleaning fluid wiped off by the squeegee. The fluid collecting arrangement 30 further includes a funnel arranged above and behind the rear of the brush 11 to transport the collected cleaning fluid to the container 18 for reuse. The funnel includes an inclining sheet 34 having one end 35 arranged below the fluid-collecting brush 32 and the other end arranged behind and above the rear of the brush 11. The fluid collecting arrangement 30 includes a filter 36, and is arranged to transport the collected cleaning fluid to the container 18 via the filter 36 in order to purify the cleaning fluid. The filter is a unit can easy be removed for cleaning/replacement.

During the washing process the brush will deposit cleaning fluid onto the façade. The wiper device 22 above the rotating brush will wipe off the now 'dirty' cleaning fluid that will flow down into the container 18. The brush rotation will cause the fluid to splash upwards and into the housing 10. The funnel 34 collects the splash from the brush and directs it to a vertical filter section along the outside wall of the cleaning apparatus. The fluid flows through the filter 36 and dirt is separated from the fluid before it returns to the fluid container 18 at the bottom of the apparatus.

The fluid-collecting brush 32 is, for example, a linear brush. The rubber blade of the squeegee 22 is more resilient than the fluid-collecting brush 32. The apparatus is arranged to disengage the rotation of the brush during an upward return travel, and the disengagement of the brush rotation torque causes the brush and squeegee to reverse from the façade, as shown in FIG. 4*b*. The squeegee 22 and the fluid-collecting brush 32 are arranged so that the upper end 33 of the linear brush is in contact with the squeegee during an upward travel of the apparatus 1 to wipe off dirt from the squeegee. This enables the lower edge of the squeegee to be cleaned from dirt every time the apparatus is stopped/reversed. Apparatus can be stopped and reversed shortly by automatic means if the squeegee needs to be cleaned from dirt particles such as sand/dust on its lower edge.

The apparatus is arranged to disengage the rotation of the brush during an upward travel of the apparatus, and the apparatus is arranged so that the disengagement of the brush rotation causes the squeegee 22 and the fluid collecting arrangement 30 to move away from the façade and thereby cases squeegee to be moved in contact with the fluid collecting brush.

FIGS. 2 and 5*a-b* illustrate an example of a drive mechanism for rotating the brush 11. FIG. 5*a* shows the apparatus during down movement of the apparatus and FIG. 5*b* shows the apparatus during upward movement of the apparatus. Brush axles 40 are fixedly connected to the ends of the brush 11. The brush axles 40 are connected to bearing houses 42 at each end of the apparatus. The bearing houses 42 are connected to the side plates 7 of the housing 10 via an axle 44, which is carrying the driving wheels 16, and is the rotational centre of the driving wheels. There is an offset distance between the brush centre and wheel centre. The link arm 24 is coupled to the brush axle 40. In this example, the brush axle 40 is coupled to the drive wheel 16 via a cog wheel 46. The bearing house 42 pivots around the axle 44 of the drive wheel.

When the driving wheels 16 rotate during down movement of the apparatus, the reaction torque forces due to friction in bearings and the contact force between the brush 11 and the façade make the bearing house 42 pivots around the wheel axle 44 in the same direction as the wheel rotation direction. If necessary, it is also possible to add enough friction into the bearing to pivot the bearing house. The pivot movement causes the brush 11 to swing up and towards the surface of the façade. The mass of the brush 11 and bearing parts is to a certain extent balanced by a spring attached to a link mechanism on the inside of the side plate of the cleaning apparatus to reduce the need for friction to make the pivot mechanism work. The squeegee 22 is moved synchronized in with the bearing houses. The working position in tilted position is adjusted by two end stops to give the appropriate brush and squeegee compression during cleaning. The transmission between the driving wheels 16 and the brush 11 disengages the brush 11 during reverse rotation during upward motion of the equipment, as shown in FIG. 4*b*. When the rotation stops and the wheel torque drops, the bearing houses with the brush will move back to its starting position by force of gravity.

In the following an example of a method for cleaning a façade with the cleaning apparatus 1 will be described with reference to the FIGS. 1, 2 and 4*a-b*.

The apparatus is mounted on the façade by engaging the sliding elements 6 to the slots 4 provided on the wind posts 3 of the building, as shown in FIGS. 1 and 2. The wires 8 are attached to the housing 10 of the apparatus. The apparatus 1 is vertically moved in a downward movement guided by the steering guides while the front part 14 of the rotating brush 11 and the wiper device 22 are in contact with the surface of the façade panel 2, and the drive wheel 16 is in contact with the wind post 3. The cleaning process is done as the apparatus slides vertically downwards from the top of the building with the sliding elements 6 sliding in the slots 4 on the wind posts, as shown in FIG. 1, and while the front part 14 of the rotating brush is in contact with the surface 2 of the façade panel.

The drive wheels 16 rotate against the outside surface of the wind posts 3. The contact force on the drive wheels 16 generates a friction powered torque during the movement of the apparatus. During down movement, the friction torque of the drive wheel 16 is used to rotate the brush 11 and to press the brush 11 and the wiper device 22 against the façade panel 2, as shown in FIG. 4*a*. The friction powered torque of the drive wheel is transferred to the rotating brush. During cleaning, the brush is rotated in an upward direction relative to the façade. Before touching the façade the brush 11 passes a wetting area under the brush, as shown in FIG. 4*a*. The wetting area includes the container 18 and the fluid feeding device 20.

The cleaning is done by the rotating brush 11, which adds cleaning fluid to the surface of the façade panel 2 and sweeps it covering the width of the façade panel 2. The rotating brush is fed with cleaning fluid from the container 18 by means of capillarity forces. Cleaning fluid is transported to the upper end 21 of the fluid feeding device 20 by means of capillarity forces. The bristle 12 of the brush 11 is in contact with the upper end 21 of the feeding device. Cleaning fluid is transferred to the bristle 12 of the brush 11 during the contact. The brush is rotated relative the feeding device so that the bristle of the rotating brush or the upper end of the feeding device is bent during the contact between them, thereby causing cleaning fluid to be splashed towards the surface of the façade when the contact with the feeding device is released, as shown in FIG. 4*a*.

The used cleaning fluid is collected by a fluid-collecting brush 32 arranged below the wiper device 22 and percolated through a filter 36 and thereafter transported to the container 18 for reuse.

If the fluid level in the container 18 descends below the outlet 30 of the hose 26, fluid from the tank 21 will fill up until the level is above the outlet 30.

The speed of the down movement is dictated by the crane 9. When the down movement is stopped, the friction powered torque generated by the drive wheels 16 ceases and accordingly the press of the brush 11 and the wiper device 22 against the façade panel 2 ceases, which cases the brush and the wiper device to swing back to their home positions and the rotation of the brush Ills disengaged, as shown in FIG. 4*b*. Thus, the brush 11 and the wiper device 22 are reversed from the façade. This is due to a swinging motion of the link arm 34. The swinging of the link arm is caused by the gravity acting on the brush. The disengaging of the transmission of friction powered torque to the brush causes the brush to reverse from the façade and stop rotating. When the rotation stops and the wheel torque drops the brush 11 will move back to its starting position by force of gravity.

The present invention is not limited to the embodiments disclosed but may be varied and modified within the scope of the following claims.

The invention claimed is:

1. A cleaning apparatus (1) for cleaning façades on multi-story buildings, the cleaning apparatus (1) comprising:

a rotating brush (11) arranged rotatable about its longitudinal axis, a drive mechanism (16, 44, 46) for rotating the brush (11), a container (18) for housing a cleaning fluid, a fluid feeding device (20) arranged to feed the rotating brush (11) with cleaning fluid from the container (18) by capillarity forces, sliding elements (6) arranged to engage steering guides (4) provided along posts (3) on the façade for securing the cleaning apparatus (1) to the façade and vertically guiding the cleaning apparatus (1), a wiper device 22 arranged above the rotating brush (11) to contact the façade during cleaning to wipe off used cleaning fluid from the façade, and a fluid collecting member (30) arranged to collect the cleaning fluid wiped off by the wiper device (22) and transport the collected cleaning fluid to the container (18) for reuse, wherein the drive mechanism (16, 44, 46) for rotating the brush (11) is powered solely by gravity and comprises at least one drive wheel (16) arranged to contact the surface of the façade and a transmission unit (40, 42, 46), downward movement of the cleaning apparatus (1) due to gravity drives the driving wheel (16) to generate a friction-powered torque during downward movement of the cleaning apparatus (1) due to frictional rotation of the drive wheel (16) against the surface of the façade, and the transmission unit (40, 42, 46) is arranged to transfer the torque of the drive wheel (16) to the rotating brush (11) to make the rotating brush (11) rotate during the downward movement.

2. The cleaning apparatus according to claim 1, wherein the apparatus comprises a housing (10) provided with an opening (13), and the rotating brush (11) is arranged so that a front part (14) of the brush is facing the opening of the housing, and the feeding device is arranged below the rotating brush and so that the bristle (12) of the rotating brush and/or the upper end (21) of the feeding device is bent during contact between them, and the drive mechanism is arranged to rotate the rotating brush in a direction relative the feeding device so that cleaning fluid is splashed towards the opening of the housing when the contact between bristle the feeding device is released.

3. The cleaning apparatus according to claim 2, wherein the fluid feeding device (20) is arranged inclined towards the opening of the housing.

4. The cleaning apparatus according to claim 1, wherein the fluid feeding device (20) includes a large number of elongated elements extending in the longitudinal direction of the device and ending at the upper end of the device, the elongated elements being arranged essentially in parallel so that the cleaning fluid is transported between the elongated elements by means of capillarity forces.

5. The cleaning apparatus according to claim 1, wherein the fluid feeding device (20) comprises a linear brush including a bristle arranged with its upper end in contact with the bristle of the rotating brush.

6. The cleaning apparatus according to claim 1 wherein the container (18) is positioned below the rotating brush (11).

7. The cleaning apparatus according to claim 1, wherein it comprises a self-leveling mechanism (21, 26) for automatically keeping the fluid in the container (18) at an essentially constant level.

8. The cleaning apparatus according to claim 7, wherein said self-leveling mechanism (21, 26) is arranged to keep the fluid in the container (18) at a level in the range of about 0.5-4 cm below the rotating brush.

9. The cleaning apparatus according to claim 7, wherein said self-leveling mechanism comprises:

a tank (21) for housing cleaning fluid, the tank being arranged above and in fluid communication with the container (18), and a pipe (26) having an inlet (28) arranged in the bottom of the tank and an outlet (30) arranged inside the container and just below the fluid level of the container.

10. The cleaning apparatus according to claim 1, wherein it comprises a filter (36) and the fluid collecting member (30) is arranged to transport the collected cleaning fluid to the container via said filter.

11. The cleaning apparatus according to claim 1 wherein the fluid collecting member (30) comprises:

a fluid-collecting brush (32) is arranged below the wiper device (22) so that an upper end (33) of the fluid-collecting brush is in contact with the façade during downward travel of the apparatus to collect cleaning fluid wiped off by the squeegee, and an inclining sheet (34) having one end arranged below the fluid-collecting brush to transport the collected cleaning fluid to the container (18) for reuse.

12. The cleaning apparatus according to claim 11, wherein the wiper device (22) and the fluid-collecting brush (32) are arranged so that an upper end (33) of the fluid-collecting brush is in contact with the wiper device (22) during an upward travel of the apparatus to wipe off dirt from the wiper device and the apparatus is arranged to disengage the rotation of the brush during an upward travel of the apparatus, and the apparatus is arranged so that the wiper device and the fluid collecting member (30) are move away from the façade when the movement of the brush is revered thereby causing the wiper device to be moved in contact with the fluid collecting brush.

13. A method for cleaning a façade using the cleaning apparatus (1) according to claim 1, wherein the method comprises:

engaging the cleaning apparatus to steering guides provided on the façade of the building, moving the apparatus vertically in a downward movement guided by the steering guides while said front part of the rotating brush said drive wheel, and said wiper device are in contact with the surface of the façade, transmission of the friction powered torque of the drive wheel to the rotating brush to make the brush rotate and to press the brush against the façade, feeding the rotating brush with cleaning fluid from said container by means of capillarity forces, collecting the cleaning fluid wiped off by said wiper device, and transporting the collected cleaning fluid to the container for reuse.

14. The method according to claim 13, wherein the method comprises during an upwards return movement:

disengaging said transmission of friction powered torque to the brush thereby causing the brush to reverse from the façade and stop rotating.

15. The method according to claim 14, wherein the method further comprises during said downward movement:

transmission of the friction powered torque of the drive wheel to the wiper device to press the wiper device against the façade, and the method further comprises during said upward movement:

disengaging said transmission of friction powered torque to the wiper device thereby causing the wiper device to reverse from the façade.

16. The cleaning apparatus according to claim 1, wherein the sliding elements (6) are arranged to engage and slide along slots forming the steering guides (4) along the sliding posts (3).

17. The cleaning apparatus according to claim 1, wherein the drive wheel (16) and brush (11) are arranged to rotate upwardly against the surface of the façade during downward movement.

18. The cleaning device according to claim 1, additionally comprising a pivot arm (23) coupled to the wiper device (22), and link arms (24) interconnecting the pivot arm (23) with axle ends of the brush (11), such that during the downward movement, the link arms (24) raise the pivot arm (23) and press the wiper device (22) against the surface of the façade, and during an upward movement, the wiper device (22), brush (11) and drive wheel (16) are spaced away from the surface of the façade.

19. The cleaning device according to claim 18, wherein the drive mechanism (16, 44, 46) additionally comprises a first axle (40) fixedly connected to the axle end of the brush (11), a cog wheel (46) coupling the drive wheel (16) to the first axle (40), a second axle (44) connected to a housing (10) of the cleaning apparatus (1) and supporting the drive wheel (16) at a rotational center thereof, such that the rotational centers of the drive wheel (16) and brush (11) are offset, and a bearing housing (42) connected to the housing (10) of the cleaning apparatus (1) through the second axle (44) and also connected to the first axle (40), with the link arm (24) coupled to the first axle (40).

* * * * *